United States Patent [19]

Colin et al.

[11] Patent Number: 4,806,222

[45] Date of Patent: Feb. 21, 1989

[54] COUNTER-CURRENT ELECTROLYTE INJECTOR

[75] Inventors: Gérard R. Colin, Plappeville; André Klein, Homecourt; Alain Leclercq, Moulins-les-Metz; Patrick Mara, Talange, all of France

[73] Assignee: Société Anonyme: Société Lorraine de Laminage - SOLLAC, Florange Cedex, France

[21] Appl. No.: 44,403

[22] Filed: Apr. 30, 1987

[30] Foreign Application Priority Data

May 5, 1986 [FR] France ..... 86 06601

[51] Int. Cl.[4] ..... C25D 17/00

[52] U.S. Cl. ..... 204/206

[58] Field of Search ..... 204/206, 273, 275

[56] References Cited

U.S. PATENT DOCUMENTS

| | | | |
|---|---|---|---|
| 3,975,242 | 8/1976 | Matsuda | 204/206 |
| 4,500,400 | 2/1985 | Komoda | 204/206 |
| 4,601,794 | 7/1986 | Tsuda | 204/206 |

*Primary Examiner*—T. M. Tufariello

*Attorney, Agent, or Firm*—Bacon & Thomas

[57] ABSTRACT

The invention is concerned with an electrolyte injector for an electrogalvanizing line, wherein electrolyte is injected backwards into the space between the steel strip 14 and the anodes 15. The injector, disposed on the side where the rising strip leaves the electrolyte bath 12, has a nozzle 9 provided with a plurality of injection pipes 11 allowing the electrolyte from the bath 12 to pass freely between these pipes 11.

4 Claims, 2 Drawing Sheets

COUNTER-CURRENT ELECTROLYTE INJECTOR

The invention concerns installations for surface treatment operations, such as picking, degreasing, phosphating, and in particular, installations for the electroplating of steel strip.

An electrogalvanizing line comprises one or more cells filled with an electrolyte solution, in which the steel strip is immersed in order to coat it on one or both sides. The steel strip passes over cathodically charged conductor rolls, half submerged in the electrolyte. Soluble zinc anodes are immersed in the electrolyte and are disposed parallel to, but separated from, the conductor rolls. Guided by the conductor rolls, the strip passes through the gap between these rolls and the soluble zinc anodes.

A considerable disadvantage of this arrangement is that it leads to a depletion of the cathodic electrolyte film, which is insufficiently renewed in the space between the conductor rolls and the zinc anodes. This depletion leads to a limitation in the current density. The electrolyte within this space becomes saturated, since it is entrained by viscous drag, markedly reducing the velocity of the strip relative to the solution. The productivity of the electrogalvanizing line is thus reduced.

In order to overcome these disadvantages, and to increase both the speed of the strip and the current density, the Europen Pat. No. Ep 0 125 707, the U.S. Pat. Nos. 3,95,242 and 4,500,400 and the British Pat. Nos. GB 2 147 009 disclose counter-current injection devices, in which the electrolyte is injected backwards into the space between the anodes and the strip.

When these counter-current electrolyte injection devices are disposed on the side where the rising strip leaves the electrolyte bath, their injection nozzle is placed below the bath surface (U.S. Pat. No. 4,500,400).

The known electrolyte injection devices have a serious drawback, which is detrimental to the quality of the coating. In effect, these known injectors draw air into the space between the strip and the anodes. They are equipped with a flat, rectangular-section, injection nozzle, whose extremity is either split along its entire length, or pierced with a multitude of holes, so that the electrolyte is injected in the form of a sheet or multiple jets. The injection nozzle is placed parallel to and at a short distance from the strip, between the latter and the top of the anodes. Since the injection nozzle is situated below the surface of the bath, and because the electrolyte leaves the nozzle at high velocity, a low pressure zone is created at the bath surface due to a pump effect. As the space between the strip and nozzle is relatively small, the rate at which the electrolyte flows in from the strip and nozzle edges is insufficient to compensate for this pressure drop. A trough is therefore formed at the bath surface, causing air to be sucked into the space between the strip and the anodes.

A first solution proposed by the specialists is to submerge the injector deeper, or even completely, in the electrolyte to eliminate the pump effect. This solution is not readily acceptable, since it leads to a reduction in the useful length of the anodes. It also requires the anode tops to be submerged, so that the operators can no longer visually check the positioning of the anodes.

Another way to avoid the depletion of the cathodic electrolyte film is to widen the gap between the anodes and the conductor roll. The disadvantage of this solution is that the electric power consumption is greater.

The aim of the present invention is to overcome the above disadvantages of known counter-current injectors, without having to modify the gap between the anodes and the conductor roll, and to enable the electrolyte to be injected at a rate sufficient to cover the entire space between the anodes and the steel strip entrained by the conductor roll.

According to the present invention, this objective is attained by using an injector comprising a large number of individual injection tubes, separated from each other in such a way as to ensure a sufficiently large electrolyte flowrate.

The characteristics and advantages of the invention will be made clear in the following description, given as a non-limiting example, with reference to the appended figures, in which.

Figure 1:
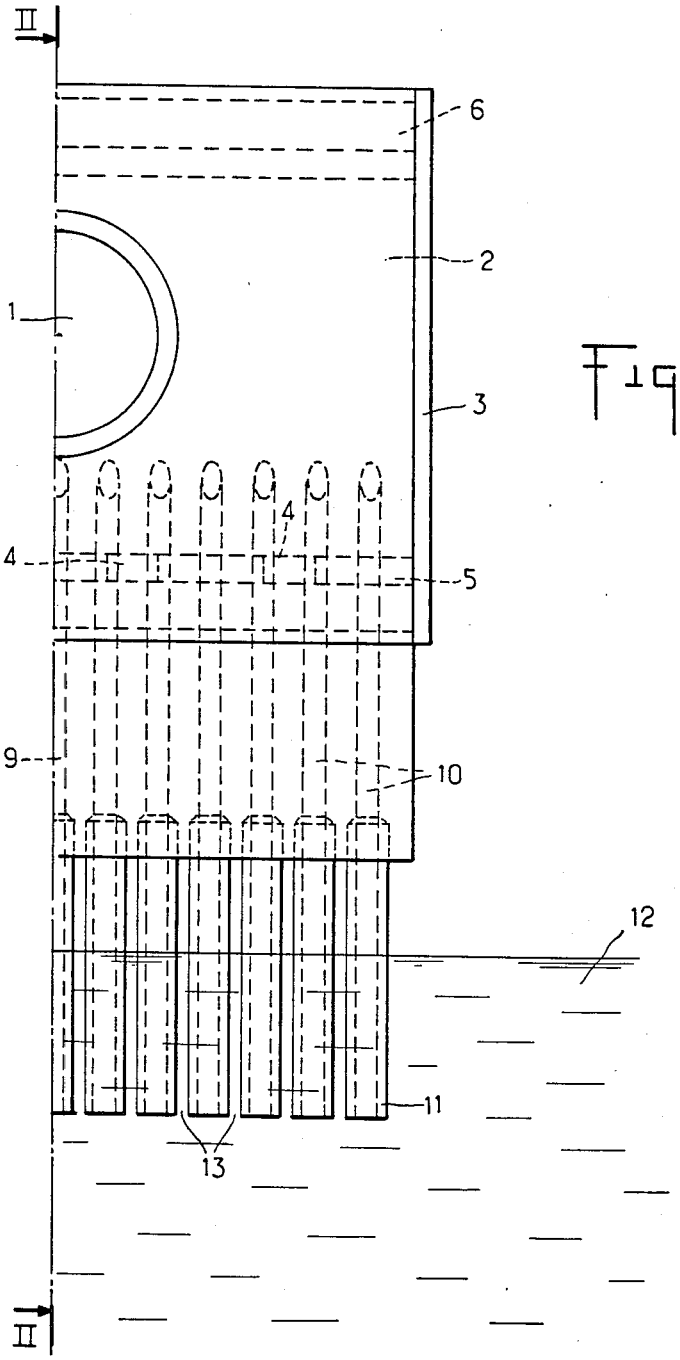
FIG. 1 represents a partial front view of the injector (along arrow 1 in FIG. 2)
Figure 2:
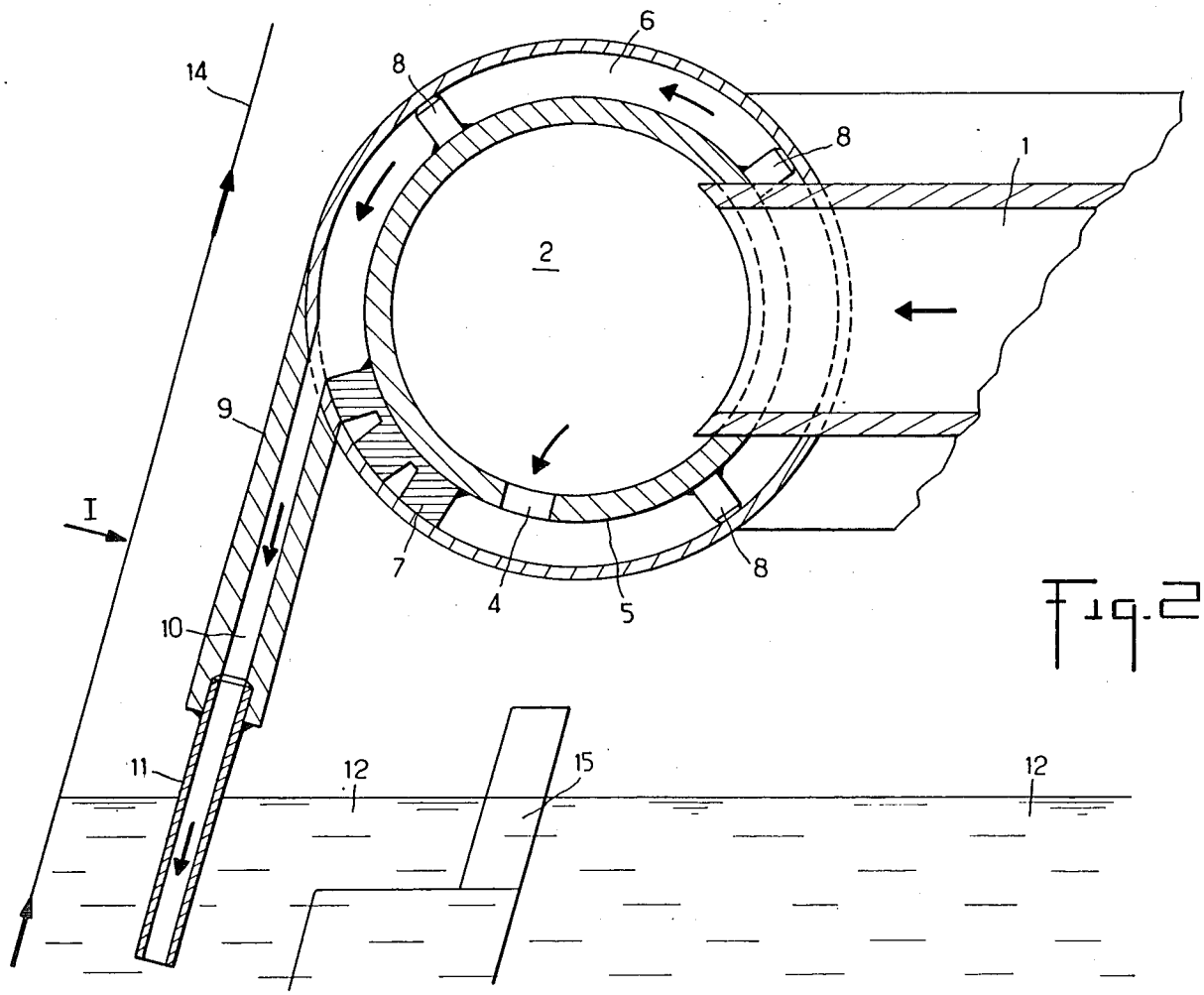
FIG. 2 is a section along II—II in FIG. 1.

The injector according to the invention comprises at least one electrolyte inlet duct (1), the number and diameter of ducts (1) varying both with the length of the injector, itself dependent on the length of the cathodic conductor roll over which the strip (14) passes, and also with the electrolyte flowrate required to ensure complete coverage of the space between the soluble anodes (15) and the strip (14), (FIG. 2). This duct (1) emerges into a central chamber (2), of circular section, for distributing the flow of electrolyte. The central chamber (2) extends along the whole length of the injector and is closed at both ends by the stoppers (3). This central chamber (2) comprises numerous openings (4) drilled through the internal wall (5) of the injector.

These openings (4) give out into a peripheral chamber (6), coaxial with the central chamber (2) and surrounding it along the whole of its length, and which serves to homogenize the flow of electrolyte. The openings (4) are located in the lower part of the central chamber (2), in the vicinity of a barrier (7), so as to direct the flow of electrolyte in the peripheral chamber (6) in a single direction.

In order to maintain the coaxial alignment of the two chambers (2) and (6), a sufficient number of centering pins (8) are inserted in the peripheral chamber (6).

The flow of electrolyte is directed by the peripheral chamber (6) into a nozzle (9), in which are drilled numerous holes (10). An essential feature of the invention is that this nozzle (9) is extended by the injection tubes (11). In effect, contrary to known injectors with a single, flat, rectangular section, injection nozzle, whose extremity is either split across the whole width or pierced with numerous holes, the injector of the present invention comprises a large number of injection tubes (11), making it resemble a comb. These injection tubes (11) are designed so that the electrolyte in the bath (12) can flow freely between them. In order to ensure a sufficient flow of eletrolyte from the bath into the space between the rolls and the anodes, the width of the anode tops (15) is decreased.

In a preferred embodiment of the invention, the extremity of each injection tube is flattened into a "fish-tail" form, in order to ensure a more uniform injection of electrolyte.

The total cross-sectional area of the gaps (13) between the tubes (11) is such as to produce a sufficient reduction in the pressure drop created between the strip

(14) and the injector, and eliminates the undesirable entrainment of air between the soluble anodes (15) and the strip (14). The injection tubes (11) are preferably designed so as to be able to be dismantled from the nozzle (9).

We claim:

1. Counter-current fluid injector composed of a fluid inlet duct, a chamber and an injection nozzle, characterized by the fact that it comprises:

at least one fluid inlet duct (1), a central fluid flow distribution chamber (2) extending along the whole length of the injector, into which emerges the inlet duct (1), numerous openings (4) drilled through the internal wall (5) of the injector, in the lower part of the said central chamber (2), a peripheral chamber (6), coaxial with the central chamber (2) and surrounding it along the whole of its length, which serves to homogenize the flow of fluid, and into which are inserted a sufficient number of centering pins (8), a barrier (7) situated in the peripheral chamber (6) for directing the flow of fluid, a nozzle (9) drilled with numerous holes (10), numerous injection tubes (11) extending the holes (10) and allowing the electrolyte from the bath (12) to pass freely between the said tubes (11).

2. Counter-current fluid injector according to claim 1 and characterized by the fact that the extremity of the injection tubes (11) has a circular cross-section.

3. Counter-current fluid injector according to claim 1 and characterized by the fact that the extremity of the injection tubes (11) has a flat cross-section.

4. Electrodeposition line cell comprising at least one injector according to claim 1, conductor rolls, and soluble anodes (15) characterized by the fact that the width of the anode tops (15) is reduced.

* * * * *